US012693082B2

(12) United States Patent
McNally et al.

(10) Patent No.: US 12,693,082 B2
(45) Date of Patent: Jul. 28, 2026

(54) MAGAZINE CATCH FOR A FIREARM

(71) Applicant: Sig Sauer, Inc., Newington, NH (US)

(72) Inventors: Jacqueline K. McNally, Rochester, NH (US); Aaron C. Sakash, Somersworth, NH (US)

(73) Assignee: Sig Sauer, Inc., Newington, NH (US)

( * ) Notice: Subject to any disclaimer, the term of this patent is extended or adjusted under 35 U.S.C. 154(b) by 16 days.

(21) Appl. No.: 18/908,309

(22) Filed: Oct. 7, 2024

(65) Prior Publication Data

US 2026/0104217 A1 Apr. 16, 2026

Related U.S. Application Data

(60) Provisional application No. 63/590,828, filed on Oct. 17, 2023.

(51) Int. Cl.
*F41A 17/38* (2006.01)
*F41A 3/72* (2006.01)
*F41A 35/06* (2006.01)

(52) U.S. Cl.
CPC ..... *F41A 3/72* (2013.01)

(58) Field of Classification Search
CPC ..... F41A 9/59
See application file for complete search history.

(56) References Cited

U.S. PATENT DOCUMENTS 4,414,769 A * 11/1983 Mueschke ..... F41A 17/00 42/70.01
5,519,954 A * 5/1996 Garrett ..... F41A 17/38 42/6
8,327,749 B2 * 12/2012 Underwood ..... F41A 17/42 89/190
8,713,832 B2 * 5/2014 Troy ..... F41A 35/06 42/6
9,068,790 B2 * 6/2015 La Vigne ..... F41A 17/36
9,121,651 B1 * 9/2015 Jen ..... F41A 17/38
9,194,637 B2 * 11/2015 Mather ..... F41A 17/38
9,291,412 B1 * 3/2016 Montes ..... F41A 17/36
9,541,340 B2 * 1/2017 Fluhr ..... F41A 35/06
10,151,548 B2 * 12/2018 Cross ..... F41A 11/00
11,536,531 B1 * 12/2022 Geissele ..... F41A 35/02
(Continued)

FOREIGN PATENT DOCUMENTS

PL 215027 B1 10/2013
WO WO2021234095 A1 11/2021

OTHER PUBLICATIONS

International Search Report and Written Opinion received for PCT Application No. PCT/US2024/050231 (Jan. 14, 2025).

*Primary Examiner* — Derrick R Morgan
(74) *Attorney, Agent, or Firm* — Secant IP, P.L.L.C.

(57) ABSTRACT

A magazine catch for a firearm has a catch body, a leg extending longitudinally from the catch body to a distal end, where the leg has a first leg portion and a second leg portion spaced from one another by a longitudinal gap such that the second leg portion can flex independently of the first leg portion. A catch protrusion is on a distal end portion of the leg, where the longitudinal gap extends through the catch protrusion to define a first catch portion and a second catch portion. The magazine catch can be provided, for example, as a stand-alone component or component group, as part of a firearm, or in a parts kit for an existing firearm.

20 Claims, 6 Drawing Sheets

(56) References Cited

U.S. PATENT DOCUMENTS

| | | | | |
|---|---|---|---|---|
| 11,662,164 | B2 * | 5/2023 | Kastrun | F41A 17/38 42/6 |
| 12,123,676 | B2 * | 10/2024 | Huang | F41A 9/59 |
| 2010/0275485 | A1 * | 11/2010 | Findlay | F41A 35/06 42/16 |
| 2014/0338243 | A1 * | 11/2014 | La Vigne | F41A 35/06 42/16 |
| 2016/0069628 | A1 * | 3/2016 | Fluhr | F41A 35/06 42/6 |
| 2017/0199000 | A1 * | 7/2017 | Paquette | F41A 17/38 |
| 2018/0299219 | A1 * | 10/2018 | Cross | F41A 11/00 |
| 2018/0372441 | A1 * | 12/2018 | Zheng | F41A 35/06 |
| 2019/0078850 | A1 * | 3/2019 | Cross | F41A 11/00 |
| 2020/0263944 | A1 * | 8/2020 | Harris | F41A 17/36 |
| 2020/0309476 | A1 * | 10/2020 | Gibbens | F41A 3/66 |
| 2024/0318934 | A1 * | 9/2024 | Kolev | F41A 17/36 |
| 2025/0012533 | A1 * | 1/2025 | Maugham | F41A 17/36 |
| 2025/0237466 | A1 * | 7/2025 | Osborn | F41A 17/42 |
| 2025/0264293 | A1 * | 8/2025 | Geissele | F41A 3/68 |

* cited by examiner

MAGAZINE CATCH FOR A FIREARM

RELATED APPLICATIONS

This application claims the benefit under 35 U.S.C. § 119(e) of U.S. Provisional Patent Application No. 63/590,828, titled MAGAZINE CATCH FOR A FIREARM, and filed on Oct. 17, 2023, the contents of which are incorporated herein by reference in its entirety.

TECHNICAL FIELD

The present disclosure relates generally to firearms and their components. More particularly, the present disclosure relates to a magazine catch and assembly for an auto-loading rifle.

BACKGROUND

Semi-automatic and fully automatic rifles commonly are configured for use with a detachable box magazine. The magazine is installed into a magazine well on the bottom of the receiver. When the magazine is seated in the magazine well, a catch engages an opening in the magazine tube to retain the magazine in the well. For example, the catch is part of an L-shaped lever that also functions as a magazine release. A catch portion of the lever extends along a side of the receiver and includes the catch that extends through the receiver into the magazine well when the lever is in its latched position. A pin or shaft oriented perpendicular to the catch portion extends through the receiver to a release button at its distal end. A spring on the shaft biases the lever towards the latched position. The user can press on the release button, typically located on the right side of the receiver, to move the catch portion away from the opposite side of the receiver, thereby moving the catch out of engagement with the magazine (if present).

SUMMARY

The present disclosure is directed to magazine catch for a firearm, a magazine catch assembly, and a firearm including the magazine catch or the assembly. In one embodiment, the magazine catch has a leg with a catch protrusion, where the leg is slotted to provide a compliant interaction between the firearm and the magazine. For example, the slot extends longitudinally through the leg to define two legs extending in parallel, similar to a tuning fork, where the bottom leg portion is configured to flex independently of the top leg portion. The slot also extends through the catch protrusion on the leg, dividing the catch protrusion into two portions, such as an upper portion and a lower portion, in accordance with some embodiments. In some embodiments, the slot can be shaped so that the top leg generally defines a reverse J-shape or hook. For example, the slot includes a transverse slot portion that extends transversely (e.g., perpendicularly) to the longitudinal slot and intersecting the longitudinal slot.

Alternately, or in addition, part of the catch protrusion includes or is made with a relatively softer material, such as rubber or some other polymer, rather than steel. In such embodiments, the softer material of the catch surface absorbs energy associated with the firing cycle, thereby dampening vibrations in the magazine catch. Whether the magazine catch defines a longitudinal slot, includes softer material on the catch protrusion, or both, a magazine catch in accordance with the present disclosure is configured to absorb some of the force on the catch protrusion that occurs during the firing cycle, allowing the magazine and rounds in the magazine to settle more quickly and avoid a feed malfunction.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
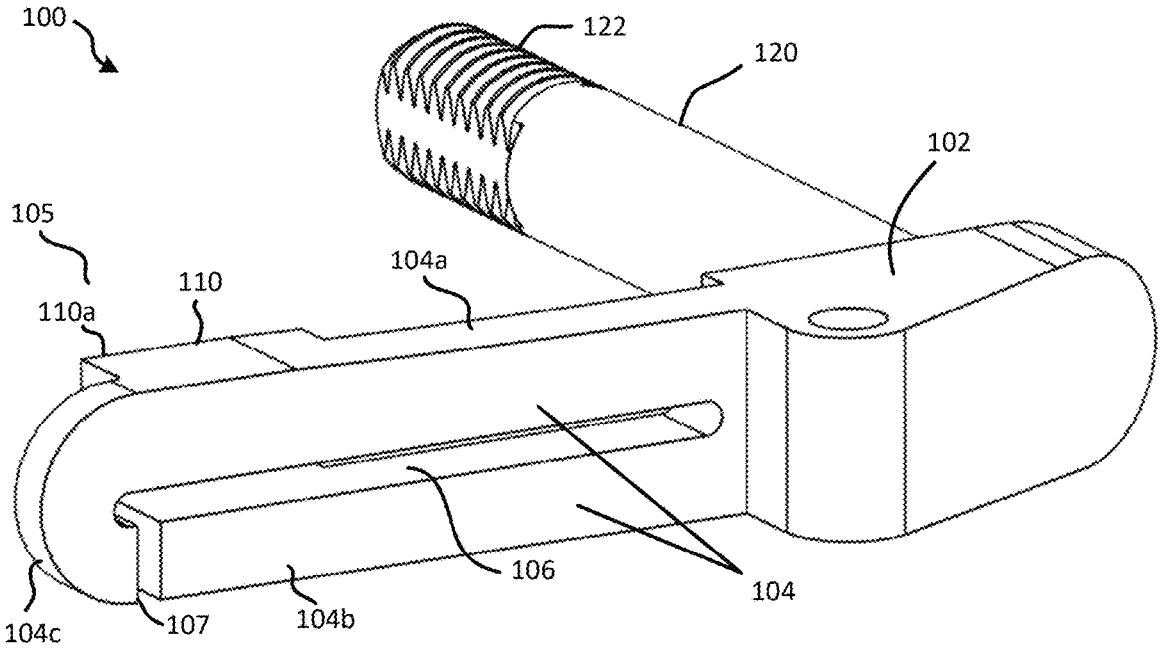
FIG. 1 illustrates a top and side perspective view of a magazine catch, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a magazine catch for a firearm, a magazine catch assembly, and a firearm including the magazine catch or the assembly. In one embodiment, a magazine catch has a catch body with a leg extending longitudinally from the body. The leg has a first leg portion spaced from a second leg portion by a longitudinal gap, and has a catch protrusion on a distal end portion of the leg, where the longitudinal gap extends through the catch protrusion to define a first catch portion and a second catch portion. The second leg portion can flex independently of the first leg portion, providing a compliant interaction between the firearm and the magazine.

In one example, the slot extends longitudinally through the catch and distal end of the leg so that the leg has two leg portions extending in parallel, similar to a tuning fork. A lower leg portion can flex upward in response to forces exerted on it when the gun is fired. In some embodiments, the slot can be modified so that the end of top leg portion generally defines a reverse J-shape or semicircular curve, for example. Alternately, or in addition, part of the catch protrusion is made with or includes a relatively softer material, such as rubber or some other polymer. Whether the bottom leg is configured to flex, the softer material is configured to absorb energy, or both, the catch lever is configured to absorb some of the force on the catch protrusion that occurs during the firing cycle, allowing the magazine and rounds in the magazine to settle more quickly and reduce or prevent the incidence of a feed malfunction.

Overview

A variety of firearms utilize a detachable magazine, including squad rifles and machine guns based, for example, on the AR-15 and AR-10 platforms. In these firearms, the magazine is retained in the magazine well using a catch that protrudes from a catch body. A post on the opposite end of the catch body extends through the firearm receiver to a retention button or nut. A spring biases the catch body so that the catch protrudes into the magazine well. When the magazine is seated in the magazine well, the catch is received in an opening or recess in the wall of the magazine, thereby retaining the magazine in the magazine well.

The magazine jostles violently during the firing cycle, which can lead to feed malfunctions. Upon firing, the bolt and bolt carrier travel rearward over the magazine. The bolt and carrier stop on a bumper at the rear of the receiver, causing the receiver to flex and transfer an upward force to the magazine. While the magazine is thrown upward, the magazine indexes the cartridges upward so that the top cartridge contacts the magazine's feed lips. The impact of the cartridges on the feed lips causes the feed lips to flex, which then provides a downward return force on the cartridges. During this upward and downward movement, the cartridges are in an unsettled state rather than being at rest against the feed lips, and the bolt may return forward before the cartridges have settled. In some cases, for example, the projectile is pitched downward during this unsettled state so that when the bolt engages a round and drives the round forward, the projectile contacts the wall surrounding the chamber, rather than the feed ramp, and the round fails to chamber correctly. In other situations, the cartridges sit lower in the magazine as a result of the downward forces. This can cause the bolt to skip over the head of the top cartridge, resulting in a failure to feed. These malfunctions, sometimes referred to as a failure-to-feed malfunction, can be particularly prevalent in rifles of larger calibers.

Therefore, a need exists for techniques to reduce feed malfunctions in semi-automatic and automatic firearms associated with movement in the magazine during the firing cycle, particularly in rifles of larger calibers. The present disclosure addresses this need and others with a magazine catch that provides a compliant interaction between the receiver and the magazine. Compared to traditional magazine catch, for example, which has a one-piece catch block made of steel, a magazine catch of the present disclosure can incorporate multiple materials and/or can have a slot through the catch. In one example, incorporating a polymer material on the catch protrusion can dampen forces during the firing cycle. In another example, a slotted leg and catch protrusion provides a compliant leg that deflects to dampen forces during the firing cycle.

As used herein, terms referencing direction, such as top, bottom, upward, downward, vertical, horizontal, left, right, front, back, etc., are used for convenience to describe a magazine catch and other components of a firearm that is oriented in a traditional shooting position with the barrel extending horizontally in front of the user. Embodiments of the present disclosure are not limited by these directional references, and it is contemplated that a magazine catch and other components described herein can be used in any orientation. Numerous variations and embodiments will be apparent in light of the present disclosure.

Example Embodiments

Figure 2:
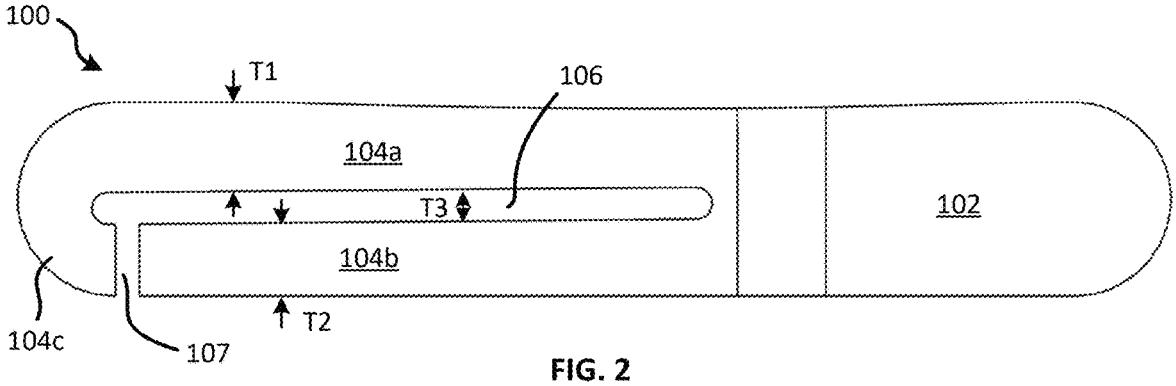
FIG. 2 illustrates a side view of the magazine catch of FIG. 1.
Figure 3:
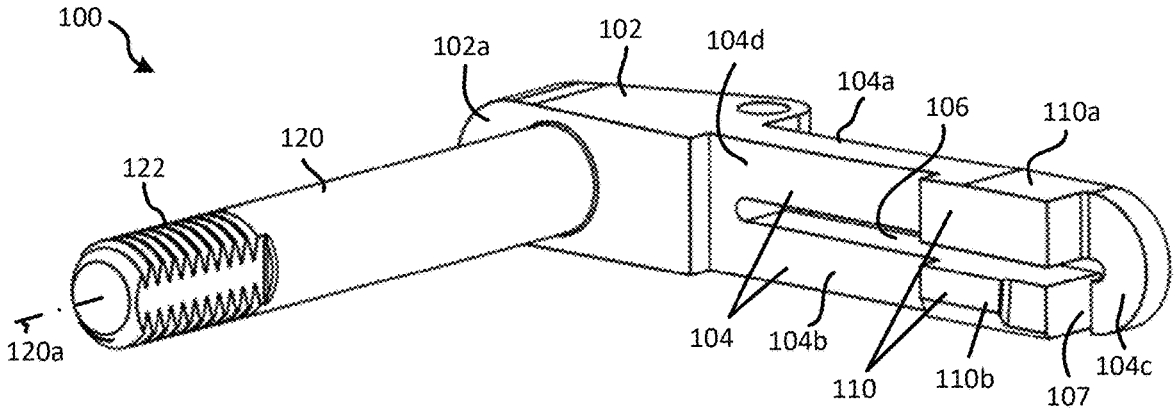
FIG. 3 illustrates a top, front, and side perspective view of the magazine catch of FIG. 1.

FIG. 1 illustrates a top and side perspective view of a magazine catch 100, in accordance with an embodiment of the present disclosure. FIG. 2 illustrates a side view of the magazine catch of FIG. 1, and FIG. 3 illustrates a top, front, and side perspective view of the magazine catch of FIG. 1. These figures are discussed concurrently below.

In this example, the magazine catch 100 includes a body 102 and a leg 104 extending from the body 102. A distal end portion 105 of the leg 104 includes a catch protrusion 110 that protrudes away from a first face 104*d* of the leg 104. A longitudinal slot 106 through the leg 104 extends along most of the length of the leg 104 to define an upper or first leg portion 104*a* and a lower or second leg portion 104*b* that is spaced from the first leg portion 104 by the slot 106. The slot 106 also extends through the catch protrusion 110 to define a first catch portion 110*a* on the first leg portion 104*a* and a second catch portion 110*b* on the second leg portion 104*b*. As shown here, the slot 106 extends from adjacent the body 102 to at least a distal end of the catch protrusion 110 so that the entire catch protrusion is separated into the first and second catch portions 110*a*, 110*b*. A transverse slot 107 extends transversely (e.g., perpendicularly) to and intersects the longitudinal slot 106 distally of the catch protrusion 110 to separate the first leg portion 104*a* from the second leg portion 104*b* except where the leg 104 is connected to the body 102 or where leg portions 104*a*, 104*b* are connected to one another close to the body 102. This allows the second leg portion 104*b* to flex independently of the first leg portion 104*a*.

As a result of the longitudinal slot 106 and transverse slot 107, the distal end portion of the first leg portion 104*a* turns back on itself generally in the shape of a reverse "J", hook, or curve 104*c*. The second leg portion 104*b* generally has an elongated rectangular shape extending in parallel with most of the first leg portion 104*a*. The distal end of the second leg portion 104*b* is spaced by transverse slot 107 from the distal end of the first leg portion 104*a*, which curves 180° back on itself. In this example, the curve 104*c* on the end of the first leg portion 104*a* is positioned distally of the catch protrusion 110. In other embodiments, the transverse slot 107 can be positioned in some other orientation to the longitudinal slot 106, such as at an angle of 45°, 60° 120°, or 135°.

The catch protrusion 110 can generally have a block shape so as to be received in a corresponding recess or opening in a magazine. In some embodiments, a bottom of the catch protrusion is chamfered so that the magazine deflects the magazine catch 100 when the magazine is installed in the magazine well. Other geometries of the catch protrusion 110 can be used, such as a hook, a tab, or combination of such shapes.

A post 120 extends away from the first face 102*a* of the body 102 so that it is substantially perpendicular (e.g., ±5°) to the leg 104. Note that the catch protrusion 110 and post 120 extend generally in parallel from the leg 104 and from the body 102, respectively. Here, the first face 102*a* of the body 102 is parallel to the first face 104*d* of the leg 104, but this is not required in all embodiments. The post 120 is sized to extend through the firearm's receiver 50 and has an end portion 122 of the post 120 that can be threaded to engage a retaining nut or button 160. In doing so, the magazine catch 100 can be retained in the receiver. Other retention mechanisms can be used to retain the magazine catch 100 in the receiver, such as a circlip, cotter pin, set screw, spring-loaded ball detent, or other suitable device, as will be appreciated. In this parallel configuration, translating the magazine catch 100 along the axis 120*a* of the post 120 also translates the catch protrusion 110, thus facilitating the user to disengage the catch protrusion 110 from the magazine 60 by pressing on a button 160 (shown in FIGS. 4-5) attached to distal end portion 122 of the post 120.

Figure 8:
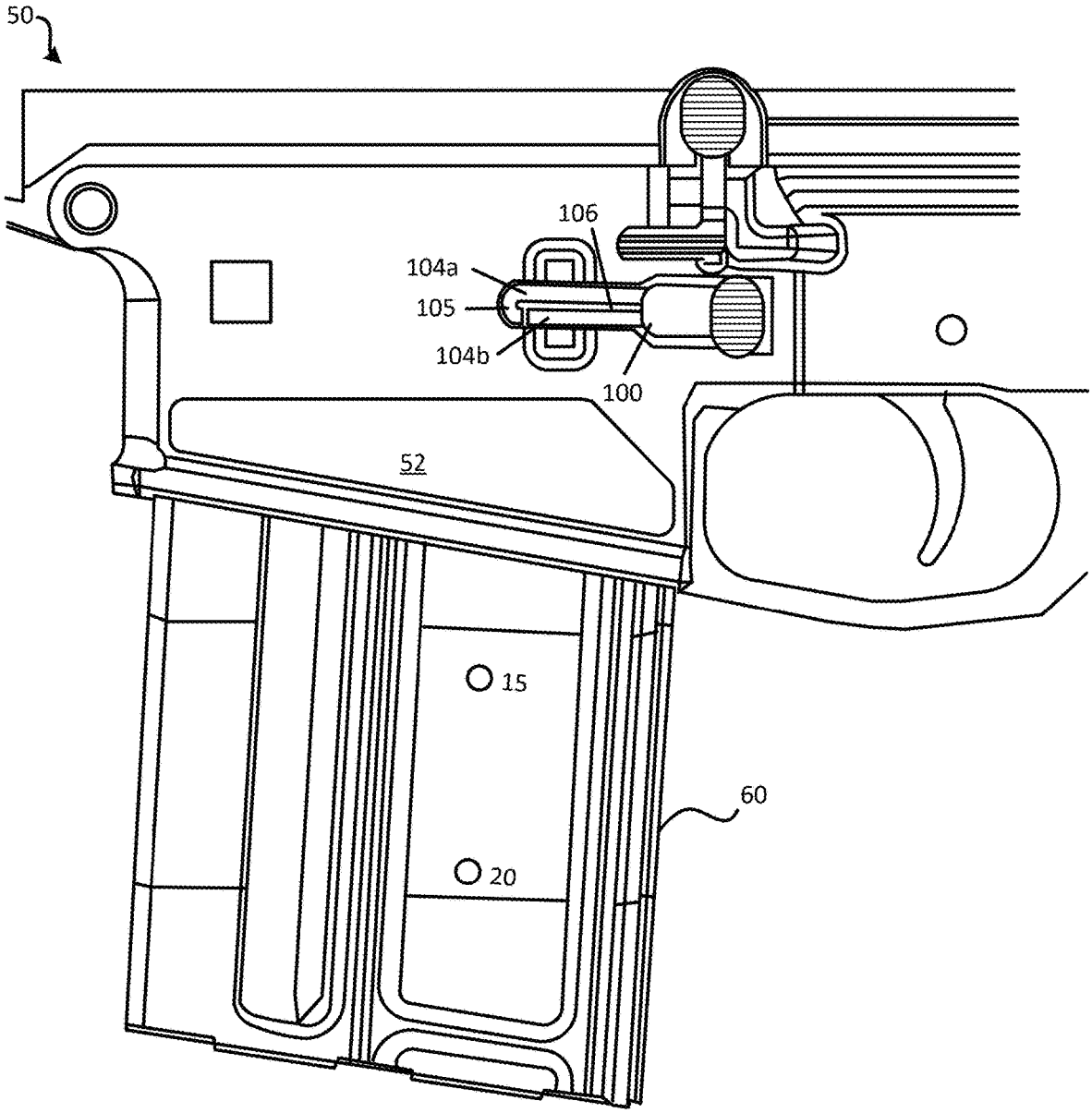
FIG. 8 illustrates a side view showing part of a firearm receiver and magazine with a magazine catch assembly installed in the receiver, in accordance with an embodiment of the present disclosure.

Conventionally, the recess or opening in the magazine wall has a vertical dimension of about 6 mm (about ¼ inch) and a horizontal dimension of about 13 mm (about ½ inch); the catch protrusion 110 is sized to be received in that opening or recess to retain the magazine 60 in the magazine well 52 (shown, e.g., in FIG. 8). In some embodiments, the longitudinal slot 106 between first leg portion 104*a* and second leg portion 104*b* can be sized to provide the desired spring force between the second leg portion 104*b* and the magazine. In one embodiment, the longitudinal slot 106 is sized and/or the second leg portion 104*b* is sized to require between 60 and 100 lbs. (265-445 N) of force at the second catch portion 110*b*, such as about 80 lbs. (355 N) of force, to deflect the second leg portion 104*b* into contact with the first leg portion 104*a*. For example, each of the first and second leg portions 104*a*, 104*b* have a vertical thickness T1, T2 of about 0.10" and are spaced by longitudinal gap 106 of distance T3 of 0.04". When made of steel, these dimensions require about 80 lbs. (~355 N) of force, applied to the second leg portion 104*b* at the second catch portion 110*b* and in a direction towards the first leg portion, to deflect the second leg portion 104*b* into contact with the first leg portion 104*a*. Other suitable dimensions can be used as deemed appropriate for a given firearm and magazine.

In this example, the vertical thicknesses T1 and T2 are equal or about equal (e.g., ±0.02"), but this is not required in all embodiments and the vertical thickness T1 can be different compared to vertical thickness T2. The longitudinal gap 106 and dimensions of first and second leg portions 104*a*, 104*b* can be selected to provide the desired dampening performance.

Note that in some embodiments, the magazine catch 100 consists only of the catch body 102 and leg 104 with catch protrusion 110, where the catch body 102 is pivotably mounted to the receiver 50, or is configured to be pivotably mounted. In one such embodiment, pressing on the catch body 102 pivots the catch protrusion 110 to the disengaged position. The principles of the leg 104 having a longitudinal slot 106 apply to such an embodiment and others. Numerous variations and embodiments will be apparent in light of the present disclosure.

Figure 4:
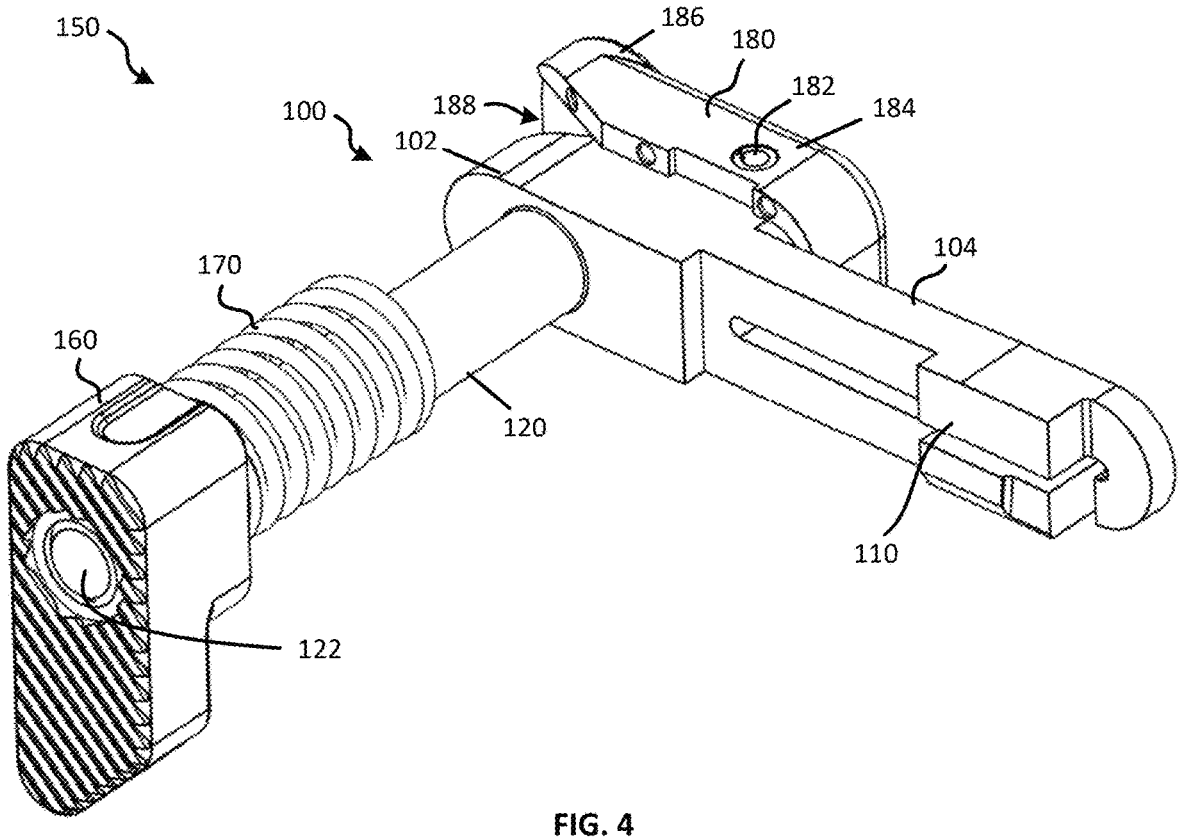
FIG. 4 illustrates atop, front, and side perspective view of a magazine catch assembly, in accordance with an embodiment of the present disclosure.
Figure 5:
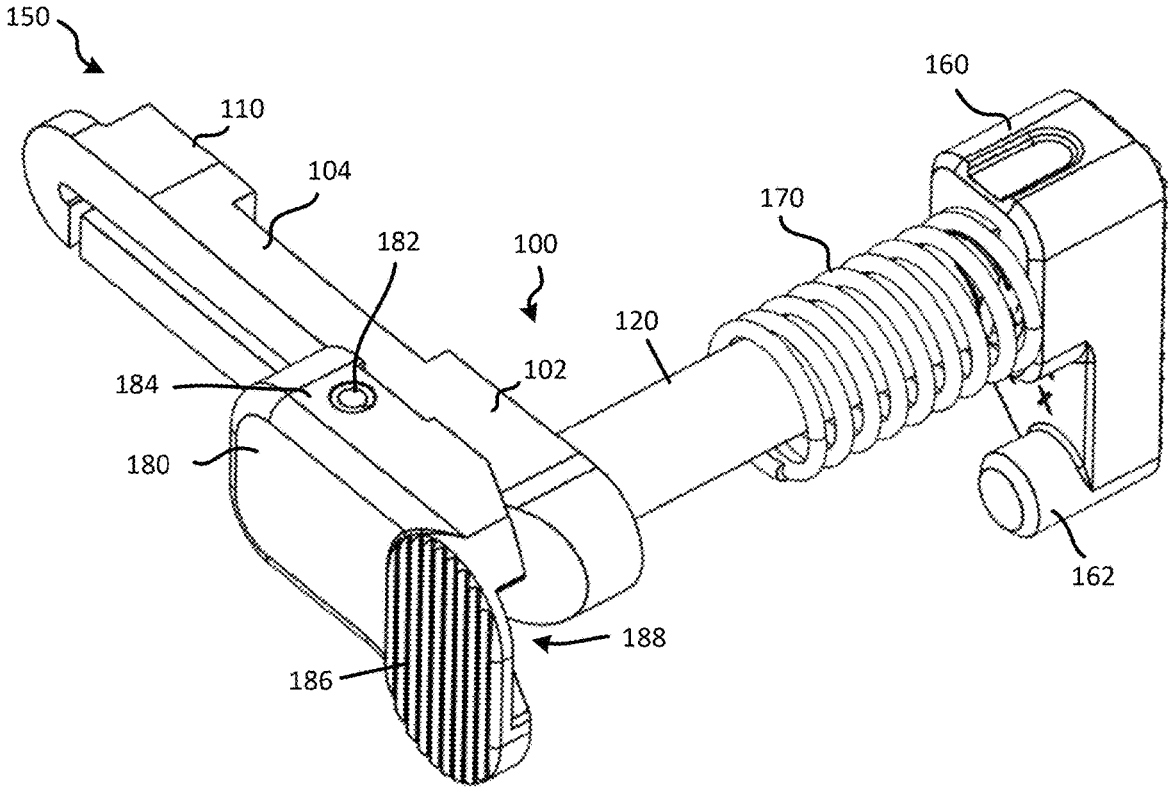
FIG. 5 illustrates a top, rear, and side perspective view of the magazine catch assembly of FIG. 4.

FIG. 4 illustrates a top, front, and side perspective view and FIG. 5 illustrates a top, rear, and side perspective view of a magazine catch assembly 150 in an assembled state, in accordance with an embodiment of the present disclosure. In this example, the magazine catch assembly 150 includes the magazine catch 100 as discussed above with reference to FIGS. 1-3. The assembly 150 also includes a retaining button 160 attached removably to, or configured to be attached removably to, the end portion 122 of the post 120, a spring 170 on the post 120, and a release lever 180 pivotably attached to the catch body 102. Although shown in an assembled form in FIGS. 4-5, it is contemplated that the magazine catch assembly 150 can be provided as a collection of parts to be installed on a firearm, whether completely or partially disassembled, for example. In one such embodiment, the magazine catch assembly 150 is provided as a parts kit to replace or upgrade an existing magazine catch on a firearm.

The retaining button 160 can be threadably attached to the end portion 122 of the post 120. In doing so, the retaining button 160 is configured to be positioned on the opposite side of the receiver from the leg 104 and functions as a retaining element to retain the magazine catch 100 in the firearm. The spring 170 can be positioned between the receiver 50 and the retaining button 160 to bias the catch protrusion 110 inward toward the magazine so as to be positioned to engage the opening or recess in the magazine. Thus, pressing on the retaining button 160 against the force of spring 170 moves the catch protrusion 110 to a disengaged position where the catch protrusion 110 disengages from the magazine to release the magazine from the magazine well. Similarly, releasing the retaining button 160 allows the spring 170 to return the magazine catch 100 to the engaged position.

In this example, the retaining button 160 includes a protrusion 162 that extends towards the receiver 50 (shown in FIG. 8). The protrusion 162 is configured, when installed, to be received in a corresponding recess or opening in the receiver 50. Accordingly, the protrusion 162 can prevent the retaining button 160 from inadvertently unscrewing from the post 120.

The release lever 180 is an optional component that is pivotably attached to the catch body 102. In this example, the release button 180 is assembled with the magazine catch 100 using a pin, such as a coil pin, that extends through the release button 180 and through catch body 102. In this example, the pin 182 extends through an end portion 184 of the release lever 180. In some embodiments, the release lever 180 is configured to receive the catch body 102 when pivoted. Alternately, the release lever 180 can be configured to bypass the catch body 102. In this example, the release lever 180 defines a cavity that receives part of the catch body 102. The release button 180 defines a user surface 186 that when depressed towards the receiver 50 (shown, e.g., in FIG. 8) causes the magazine catch 100 to translate to the disengaged position with respect to the magazine 60. When installed as shown, pushing on the user surface 186 draws the magazine catch 100 away from the receiver 50, thereby disengaging the catch protrusion 110 from the magazine 60 (if present). Accordingly, the user may use the release lever 180, the retaining button 160, or both together to translate the magazine catch 100 to the disengaged position.

Figure 6:
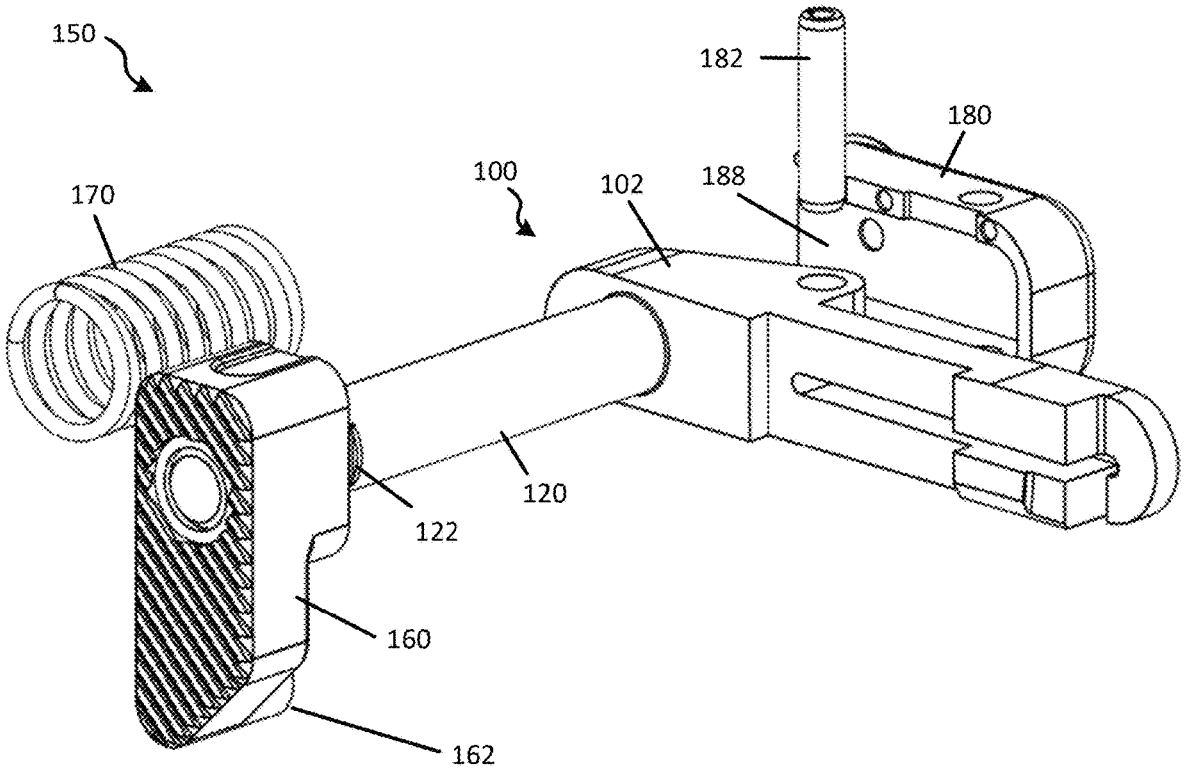
FIG. 6 illustrates a partially exploded perspective view of a magazine catch assembly, in accordance with an embodiment of the present disclosure.
Figure 7:
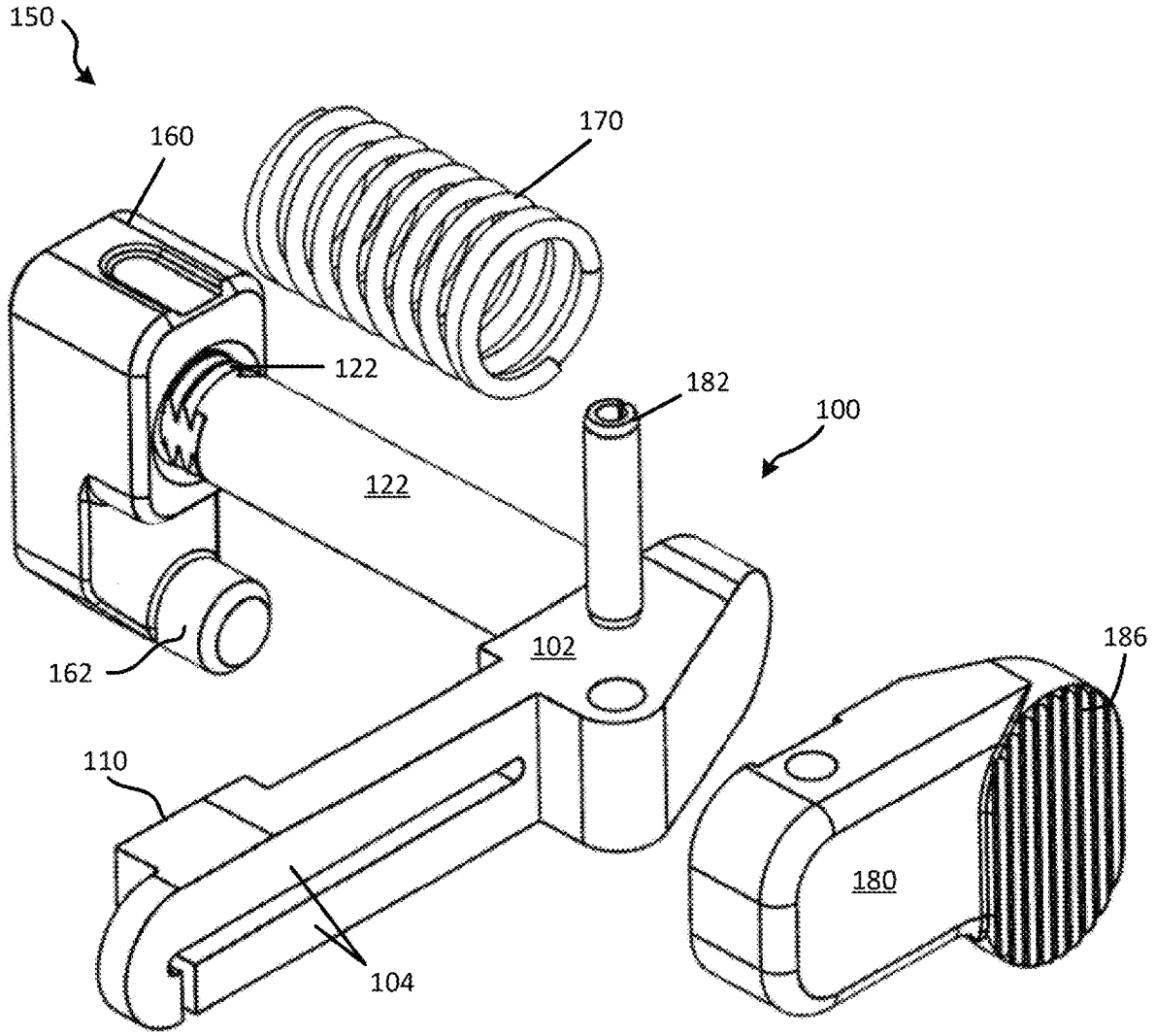
FIG. 7 illustrates a partially exploded, top, front, and side perspective view showing the magazine catch assembly of FIG. 5.

FIG. 6 illustrates a partially exploded, side, front, and side perspective view, and FIG. 7 illustrates a partially exploded, top, front, and side perspective view showing the magazine catch assembly 150 of FIGS. 4-5. In these examples, the retaining button 160 remains attached to the distal end 122 of the post 120 by threaded engagement. The release lever 180 is separated from the magazine catch 100 and reveals a pin 182 that can be used to couple the release lever 180 to the catch body 102. In FIG. 6 the cavity 188 can be seen on the back (i.e., side facing the firearm receiver when installed) of the release lever 180. The lever 120 can be integrally formed with the catch body 102 or can be a separate component that can be attached to the catch body 102, such as by threaded engagement, welding, adhesive, or some other suitable method.

FIG. 8 illustrates a side view showing part of a firearm receiver 50 with a magazine catch assembly 150 installed in the receiver 50, in accordance with another embodiment of the present disclosure. A magazine 60 is received in the magazine well 52 and engages the magazine catch 100. In this example, the magazine catch 100 is similar to that discussed above with reference to FIGS. 1-3 and includes a top or first leg 104*a* and a bottom or second leg 104*b* spaced vertically from the first leg 104*a* by a longitudinal slot 106. Here, the longitudinal slot 106 extends only part way to the distal end portion 105 from the catch body 102. As also shown in FIG. 2, a transverse slot 107 positioned distally of the catch protrusion 110 (not visible) intersects the longitudinal slot 106 to separate the first leg 104*a* from the second leg 104*b* and enable the first leg 104*a* to flex independently of the second leg 104*b* and vice versa. In this example, the first leg 104*a* has a distal end portion 105 that defines a reverse J-shape or semi-circular hook, and the second leg 104*b* is a straight segment that extends substantially in parallel with the first leg 104*a* at least to the catch protrusion 110. Note that the receiver defines vertically spaced protrusions 54 that protect the magazine catch 100 in its installed position, as shown.

Figure 9:
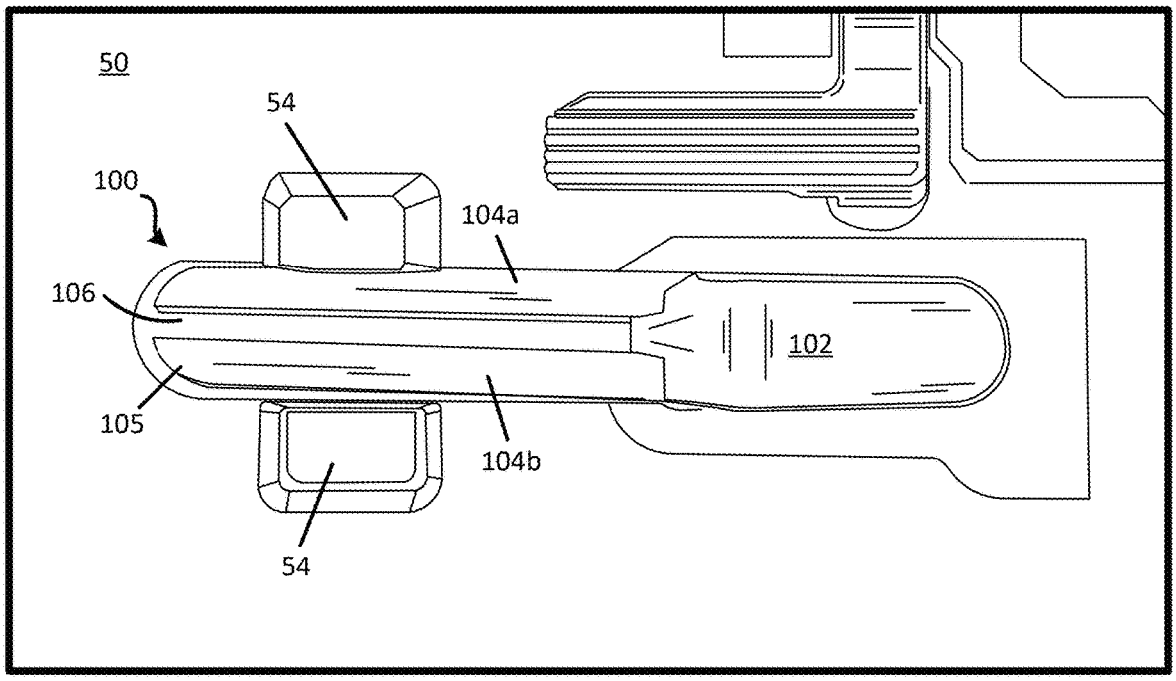
FIG. 9 illustrates a close-up, side view of part of a firearm receiver with a magazine catch, in accordance with an embodiment of the present disclosure.

FIG. 9 illustrates a close-up, side view of part of a firearm receiver 50 with an installed magazine catch 100, in accordance with an embodiment of the present disclosure. In this example, the leg 104 includes a top or first leg portion 104*a* and a bottom or second leg portion 104*b* spaced vertically from the first leg portion 104*a* by a longitudinal slot 106. Here, the longitudinal slot 106 extends through the distal end portion 105 of the leg 104 so that the first leg portion 104*a* and the second leg portion 104*b* extend substantially in parallel from the body 102, similar to a tuning fork. Note that the magazine catch omits the release lever 180 in this example.

Figure 10:
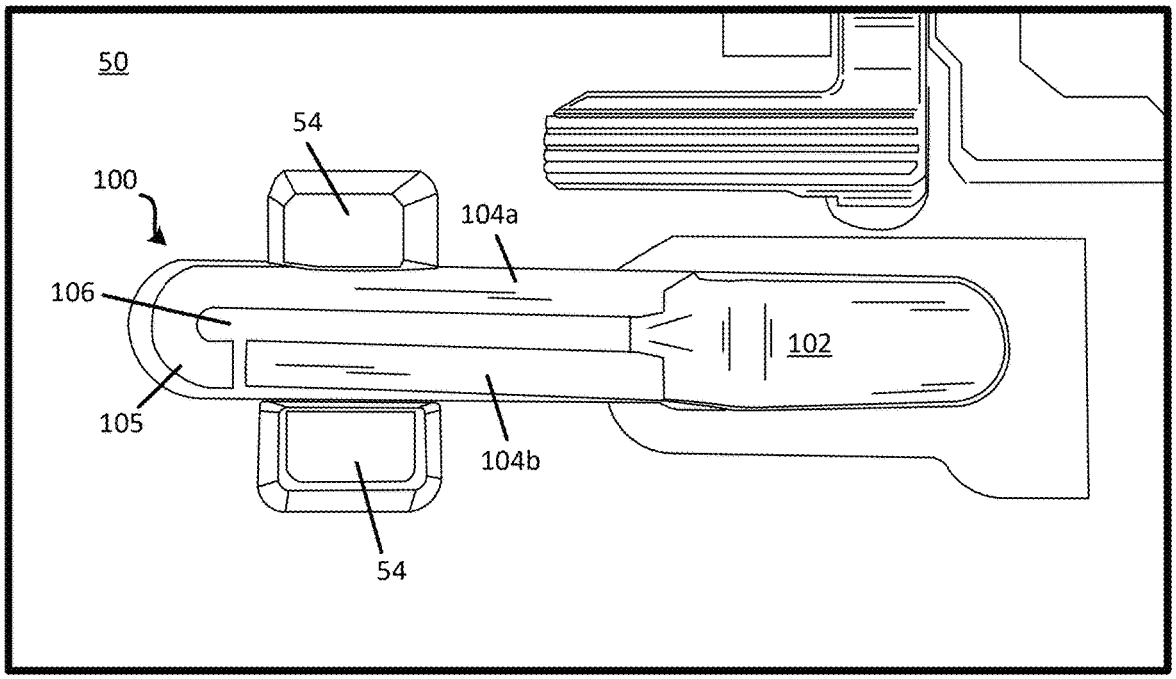
FIG. 10 illustrates a close-up, side view showing part of a firearm receiver with a magazine catch, in accordance with another embodiment.

FIG. 10 illustrates a side view showing a close-up view showing part of a firearm receiver 50 with an installed magazine catch 100. In this example, the magazine catch 100 is similar to that discussed above with reference to FIGS. 1-3 and includes a top or first leg 104 and a bottom or second leg 106 spaced vertically from the first leg 104 by a longitudinal slot 106. Here, the longitudinal slot 106 extends only part way to the distal end portion 105 from the catch body 102. A transverse slot 107 positioned located distally of the catch protrusion 110 (not visible) intersects the longitudinal slot 106 to enable the second leg portion 104*b* to flex independently of the first leg portion 104*a*. The leg 104 is received between protrusions 54. Note that the magazine catch omits the release lever 180 in this example.

FURTHER EXAMPLE EMBODIMENTS

The following examples pertain to further embodiments, from which numerous permutations and configurations will be apparent.

Example 1 is a magazine catch having a catch body and a leg extending longitudinally from the catch body to a distal end, where the leg has a first leg portion and a second leg portion spaced from one another by a longitudinal gap such that the second leg portion can flex independently of the first leg portion. A catch protrusion is on a distal end portion of the leg, where the longitudinal gap extends through the catch protrusion to define a first catch portion and a second catch portion.

Example 2 includes the magazine catch of Example 1, where the longitudinal gap extends completely through the distal end of the leg.

Example 3 includes the magazine catch of Example 1, wherein the longitudinal slot terminates between the catch protrusion and the distal end of the leg, and the leg further defines a transverse slot located distally of the catch protrusion, the transverse slot extending transversely to and intersecting the longitudinal slot.

Example 4 includes the magazine catch of Example 3, where a distal end portion of the first leg portion has width commensurate with a width of the catch body.

Example 5 includes the magazine catch of Example 1, where the second leg portion is configured to deflect to contact the first leg portion upon application of a transverse force applied to the second leg portion.

Example 6 includes the magazine catch of Example 5, where the transverse force is from 60-100 lbs. (265-445 N).

Example 7 includes the magazine catch of Example 6, where the transverse force is about 80 lbs. (355 N).

Example 8 includes the magazine catch of any one of Examples 1-7, where the magazine catch is configured to be pivotably mounted to a firearm receiver and pivotable between a catch position and a release position.

Example 9 includes the magazine catch of any one of Examples 1-7 and further includes a post extending transversely away from the catch body and sized to extend through a firearm receiver.

Example 10 includes the magazine catch of Example 9, where the post is integrally formed as one piece with the catch body.

Example 11 includes the magazine catch of Example 9, where a proximal end portion of the post threadably engages the catch body.

Example 12 includes the magazine catch of any one of Examples 9-11 and includes a retaining button configured to be removably installed on a distal end portion of the post.

Example 13 includes the magazine catch of Example 12, where, when installed in a firearm receiver, the retaining button defines a protrusion extending toward the catch body.

Example 14 includes the magazine catch of Example 12 or 13, where the retaining button threadably engages or is configured to threadably engage the distal end portion of the post.

Example 15 includes the magazine catch of any one of Examples 12-14 and includes a spring installed on the post or configured to be installed on the post between the retaining button and the catch body.

Example 16 includes the magazine catch of any one of Examples 1-15 and further includes a release lever pivotably attached to the catch body, wherein when the magazine catch is installed in a firearm receiver, the release lever is configured to move the catch protrusion away from an inside of the receiver.

Example 17 is a firearm comprising a receiver defining a magazine well and a magazine catch installed in the receiver and operable between a catch position and a release position. The magazine catch includes a catch body and a leg extending longitudinally along a side of the receiver from the catch body to a distal end of the leg, where the leg has a first leg portion and a second leg portion spaced from one another by a longitudinal gap such that the second leg portion can flex independently of the first leg portion. A catch protrusion is on a distal end portion of the leg, wherein the longitudinal gap extends through the catch protrusion to define a first catch portion and a second catch portion. A release lever is on the catch body, where pressing the release lever moves the catch protrusion away from an inside of the magazine well. In the catch position, the catch protrusion extends into the magazine well for engaging a magazine installed in the magazine well.

Example 18 includes the firearm of Example 17, where the magazine catch includes a post that extends transversely (e.g., perpendicularly) away from the catch body and sized to extend through a firearm receiver. A retaining button is on a distal end portion of the post, whether fixed or removably attached. A spring is installed on the post between the retaining button and the catch body, where pressing the release lever towards the receiver translates the magazine catch away from the receiver.

Example 19 includes the firearm of any one of Examples 17 or 18, where the second leg portion is configured to deflect into contact with the first leg portion upon application of a transverse force applied to the second leg portion, the transverse force being from 60 lbs-100 lbs. (265-445 N), preferably about 80 lbs (355 N).

Example 20 is a parts kit for a magazine catch assembly, the parts kit including a catch body with a leg extending longitudinally from the catch body, where the leg has a first leg portion spaced from a second leg portion by a longitudinal gap such that the second leg portion can flex independently of the first leg portion. A catch protrusion is on a distal end portion of the leg. The longitudinal gap extends through the catch protrusion to define a first catch portion and a second catch portion. A post extends transversely from the catch body and is sized to extend through a firearm receiver. A retaining button is configured to be removably installed on a distal end portion of the post. A spring is provided, the spring configured to be installed on the post between the retaining button and the catch body.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The invention claimed is:

1. A magazine catch comprising:

a catch body;

a leg extending longitudinally from the catch body to a distal end, the leg having a first leg portion and a second leg portion, wherein the first leg portion is spaced from the second leg portion by a longitudinal gap such that the second leg portion can flex independently of the first leg portion;

a catch protrusion on a distal end portion of the leg, wherein the longitudinal gap extends through the catch protrusion to define a first catch portion and a second catch portion; and wherein the catch protrusion is configured to engage a magazine in a magazine well.

2. The magazine catch of claim 1, wherein the longitudinal gap extends completely through the distal end of the leg.

3. The magazine catch of claim 1, wherein the longitudinal slot terminates between the catch protrusion and the distal end of the leg, the leg further defining a transverse slot located distally of the catch protrusion, the transverse slot extending transversely to and intersecting the longitudinal slot.

4. The magazine catch of claim 3, wherein a distal end portion of the first leg portion has a width commensurate with a width of the catch body.

5. The magazine catch of claim 1, wherein the second leg portion is configured to deflect to contact the first leg portion upon application of a transverse force applied to the second leg portion.

6. The magazine catch of claim 5, wherein the transverse force is from 60-100 lbs. (~265-445 N).

7. The magazine catch of claim 6, wherein the transverse force is about 80 lbs. (355 N).

8. The magazine catch of claim 1, wherein the magazine catch is configured to be pivotably mounted to a firearm receiver and pivotable between a catch position and a release position.

9. The magazine catch of claim 1, further comprising:

a post extending transversely away from the catch body and sized to extend through a firearm receiver.

10. The magazine catch of claim 9, wherein the post is integrally formed as one piece with the catch body.

11. The magazine catch of claim 9, wherein a proximal end portion of the post threadably engages the catch body.

12. The magazine catch of claim 9, further comprising:

a retaining button configured to be removably installed on a distal end portion of the post.

13. The magazine catch of claim 12, wherein when installed the retaining button defines a protrusion extending toward the catch body.

14. The magazine catch of claim 12, wherein the retaining button is configured to threadably engage the distal end portion of the post.

15. The magazine catch of claim 12, further comprising a spring installed on the post or configured to be installed on the post between the retaining button and the catch body.

16. The magazine catch of claim 1, further comprising:

a release lever pivotably attached to the catch body, wherein when the magazine catch is installed in a firearm receiver, the release lever is configured to move the catch protrusion away from an inside of the receiver.

17. A firearm comprising:

a receiver defining a magazine well;

a magazine catch installed in the receiver and operable between a catch position and a release position, the magazine catch comprising:

a catch body;

a leg extending longitudinally along a side of the receiver from the catch body to a distal end, the leg having a first leg portion and a second leg portion, wherein the first leg portion is spaced from the second leg portion by a longitudinal gap such that the second leg portion can flex independently of the first leg portion; and a catch protrusion on a distal end portion of the leg, wherein the longitudinal gap extends through the catch protrusion to define a first catch portion and a second catch portion; and a release lever on the catch body, wherein pressing the release lever moves the catch protrusion away from an inside of the magazine well;

wherein, in which the catch position, the catch protrusion extends into the magazine well for engaging a magazine installed in the magazine well.

18. The firearm of claim 17, comprising:

a post extending transversely away from the catch body and sized to extend through the receiver;

a retaining button on a distal end portion of the post;

a spring installed on the post between the retaining button and the catch body, wherein pressing the release lever towards the receiver translates the magazine catch away from the receiver.

19. The firearm of claim 17, wherein the second leg portion is configured to deflect into contact with the first leg portion upon application of a transverse force applied to the second leg portion, the transverse force being at least 60 lbs. (265 N).

20. A parts kit for a magazine catch assembly, the parts kit comprising:

a catch body;

a leg extending longitudinally from the catch body, the leg having a first leg portion spaced from a second leg portion by a longitudinal gap such that the second leg portion can flex independently of the first leg portion;

a catch protrusion on a distal end portion of the leg, wherein the longitudinal gap extends through the catch protrusion to define a first catch portion and a second catch portion;

wherein the catch protrusion is configured to engage a magazine in a magazine well;

a post extending transversely from the catch body, the post sized to extend through a firearm receiver; a retaining button configured to be removably installed on a distal end portion of the post; and a spring configured to be installed on the post between the retaining button and the catch body.

* * * * *